US009103313B2

(12) United States Patent
Burrows et al.

(10) Patent No.: US 9,103,313 B2
(45) Date of Patent: Aug. 11, 2015

(54) CORONA IGNITION DEVICE HAVING ASYMMETRIC FIRING TIP

(75) Inventors: John Antony Burrows, Northwich (GB); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 798 days.

(21) Appl. No.: 13/324,069

(22) Filed: Dec. 13, 2011

(65) Prior Publication Data

US 2012/0199088 A1 Aug. 9, 2012

Related U.S. Application Data

(60) Provisional application No. 61/422,849, filed on Dec. 14, 2010.

(51) Int. Cl.

| | |
|---|---|
| ***F02P 9/00*** | (2006.01) |
| ***F02P 23/04*** | (2006.01) |
| ***H01T 13/46*** | (2006.01) |

(Continued)

(52) U.S. Cl.

CPC ..... *F02P 9/007* (2013.01); *F02P 23/045* (2013.01); *H01T 13/467* (2013.01); *H01T 13/50* (2013.01); *H01T 21/02* (2013.01); *Y10T 29/49231* (2015.01)

(58) Field of Classification Search

CPC ..... F02P 23/045; F02P 9/007; H01T 13/50; H01T 21/02

USPC ..... 123/143 B, 169 EL, 606, 608; 315/111.21, 111.31

See application file for complete search history.

(56) References Cited

U.S. PATENT DOCUMENTS

| | | | |
|---|---|---|---|
| 1,276,105 | A | 8/1918 | Pearsall |
| 1,461,300 | A | 7/1923 | Winchester et al. |
| 1,623,432 | A | 4/1927 | Myers |

(Continued)

FOREIGN PATENT DOCUMENTS

| | | | |
|---|---|---|---|
| CN | 101057379 | A | 10/2007 |
| CN | 101895063 | A | 11/2010 |

OTHER PUBLICATIONS

International Search Report PCT/US2011/064334 mailed on Oct. 15, 2012.

*Primary Examiner* — Stephen K Cronin
*Assistant Examiner* — Xiao Mo
(74) *Attorney, Agent, or Firm* — Robert L. Stearns; Dickinson Wright, PLLC

(57) ABSTRACT

A corona ignition system for providing a corona discharge (24) includes an igniter (20) having an electrode (26) with an asymmetrical firing tip (28) relative to an electrode center axis ($a_e$). The firing tip (28) includes a first surface area ($A_1$) facing the fuel injector (42) which is greater than a second surface area ($A_2$) facing a cylinder block (32). The first surface area ($A_1$) presents a projection (60) having a sharp edge, and the second surface area ($A_2$) presents a round outward surface (62). Accordingly, a radio frequency electric field emitted from the first surface area ($A_1$) provides a robust corona discharge (24) in a flammable area at an outside edge (30) of the fuel spray. No electric field is emitted from the second surface area ($A_2$), and no power arcing occurs between the second surface area ($A_2$) and the cylinder block (32).

21 Claims, 5 Drawing Sheets

(51) Int. Cl.
*H01T 13/50* (2006.01)
*H01T 21/02* (2006.01)

(56) References Cited

U.S. PATENT DOCUMENTS

| | | | | | |
|---|---|---|---|---|---|
| 1,717,034 | A | | 6/1929 | Hoffman | |
| 1,906,918 | A | | 5/1933 | Pulliam | |
| 2,159,791 | A | | 5/1939 | Fruth | |
| 3,488,675 | A | * | 1/1970 | Eishold | 95/25 |
| 3,934,566 | A | * | 1/1976 | Ward | 123/275 |
| 3,974,412 | A | | 8/1976 | Pratt, Jr. | |
| 4,101,797 | A | | 7/1978 | Yamamoto et al. | |
| 4,124,003 | A | * | 11/1978 | Abe et al. | 123/536 |
| 5,007,389 | A | | 4/1991 | Kashiwara et al. | |
| 5,456,241 | A | | 10/1995 | Ward | |
| 5,984,668 | A | | 11/1999 | Hansen et al. | |
| 6,883,507 | B2 | | 4/2005 | Freen | |
| 7,347,174 | B2 | | 3/2008 | Jun | |
| 2004/0100178 | A1 | | 5/2004 | Kanao et al. | |
| 2005/0264151 | A1 | | 12/2005 | Mori et al. | |
| 2006/0000440 | A1 | * | 1/2006 | Kohler et al. | 123/295 |
| 2007/0095476 | A1 | * | 5/2007 | Saeki et al. | 156/345.43 |
| 2009/0316325 | A1 | | 12/2009 | Gefter | |
| 2010/0044929 | A1 | | 2/2010 | Boehler | |
| 2010/0083942 | A1 | | 4/2010 | Lykowski et al. | |
| 2010/0175653 | A1 | | 7/2010 | Lykowski et al. | |
| 2010/0175655 | A1 | | 7/2010 | Lykowski et al. | |
| 2010/0212620 | A1 | | 8/2010 | Shimizu | |

* cited by examiner

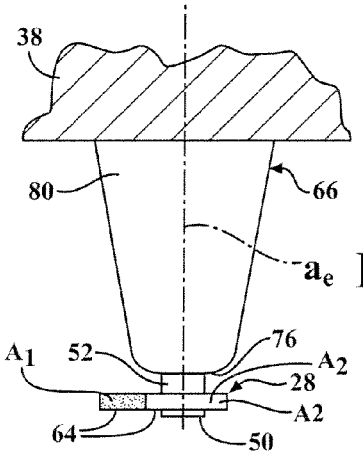
FIG. 4A
FIG. 4B
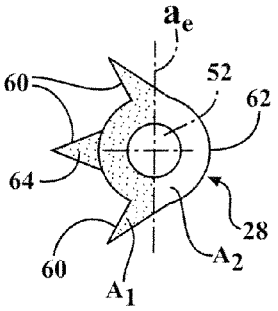
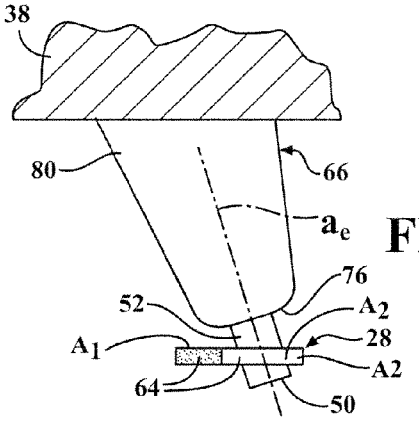
FIG. 5A
FIG. 5B
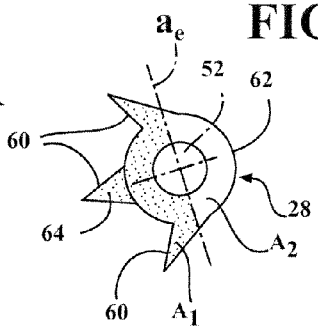
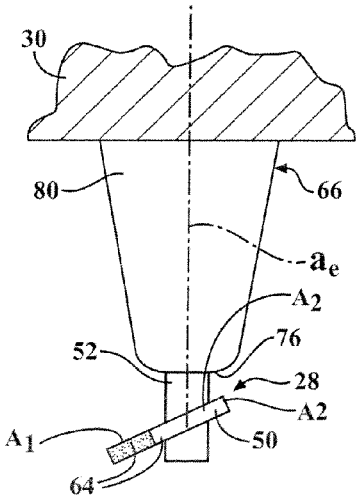
FIG. 6A
FIG. 6B
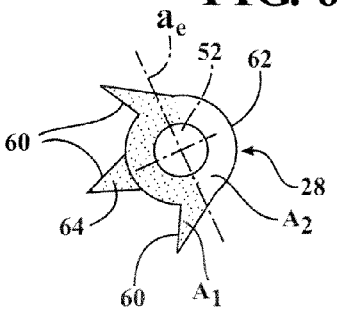

CORONA IGNITION DEVICE HAVING ASYMMETRIC FIRING TIP

CROSS REFERENCE TO RELATED APPLICATION

This application claims the benefit of U.S. provisional application Ser. No. 61/422,849, filed Dec. 14, 2010.

BACKGROUND OF THE INVENTION

1. Field of the Invention

This invention relates generally to a corona discharge ignition system including an igniter for emitting a non-thermal plasma, and more specifically to a firing tip of the igniter.

2. Related Art

An example of a corona discharge ignition system is disclosed in U.S. Pat. No. 6,883,507 to Freen. The corona discharge ignition system includes an igniter with an electrode charged to a high radio frequency voltage potential, creating a strong radio frequency electric field in the combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is also controlled so that the fuel-air mixture does not lose of all dielectric properties, which would create a thermal plasma and an electric arc between the electrode and grounded cylinder walls, piston, or other portion of the igniter, referred to as power-arcing.

The igniter of the corona discharge ignition system typically includes an electrode having an electrode body portion extending longitudinally from an electrode terminal end receiving the high radio frequency voltage, along an electrode center axis, to an electrode firing end. The electrode may include a firing tip adjacent the electrode firing end for emitting the radio frequency electric field. The firing tip is symmetric relative to the electrode center axis. The igniter of the corona discharge ignition system does not include any grounded electrode element in close proximity to the firing tip. Rather, the ground is provided by the cylinder walls or the piston of the internal combustion engine. An example of a corona igniter with a symmetric firing tip is disclosed in U.S. Patent Application Publication No. US 2010/0083942 to Lykowski and Hampton.

In internal combustion engine systems, especially non-homogeneous combustion systems, like gasoline direct ignition systems, placement of the ignition source relative to the fuel-air mixture is critical to a robust combustion. In certain engine applications, the fuel is provided to the combustion chamber as a spray, but the spray is typically too rich in fuel to ignite directly and may be flammable only at the outside edges of the spray, where the fuel mixes with the air of the combustion chamber. Accordingly, the igniter must be spaced from the fuel injector so that the firing tip is disposed in a predetermined location relative to the outside edge of the fuel spray. The igniter is also preferably spaced from the fuel spray to prevent erosion and corrosion caused by the fuel spray. However, if the igniter is too close to the cylinder walls or piston, power arcing may occur between the firing tip and the cylinder walls or piston, which would eliminate any corona discharge and could be detrimental to combustion. Further, the fuel injector oftentimes cannot be moved from a central location in the combustion chamber, which further complicates the system design.

SUMMARY OF THE INVENTION

One aspect of the invention provides an igniter for receiving a high radio frequency voltage and emitting a radio frequency electric field to ionize a portion of a fuel-air mixture and provide a corona discharge. The igniter comprises an electrode including an electrode body portion extending longitudinally along an electrode center axis from an electrode terminal end, which receives the high radio frequency voltage, to an electrode firing end. The electrode also includes a firing tip adjacent the electrode firing end for emitting the radio frequency electric field. The firing tip is asymmetric relative to the electrode center axis.

Another aspect of the invention provides a method of forming the igniter. The method comprises the steps of providing the electrode body portion extending longitudinally from the electrode terminal end along the electrode center axis to the electrode firing end. Next, the method includes disposing the firing tip on the electrode body portion adjacent the electrode firing end and asymmetrically relative to the electrode center axis.

Yet another aspect of the invention includes a corona ignition system providing a radio frequency electric field to ionize a portion of the fuel-air mixture and provide a corona discharge igniting the fuel-air mixture in a combustion chamber of an internal combustion engine. The corona ignition system includes a cylinder block extending circumferentially around a space, and a cylinder head extending across the cylinder block. A piston is disposed in the cylinder block and spaced from the cylinder head to provide a combustion chamber therebetween. A fuel injector extends into the combustion chamber for spraying fuel into the combustion chamber. The igniter with the asymmetric firing tip extends into the combustion chamber and is disposed between the fuel injector and the cylinder block. The igniter receives the high radio frequency voltage and emits the radio frequency electric field to ionize the fuel-air mixture and form the corona discharge.

Another aspect of the invention provides a method of forming the corona ignition system. The method includes providing the cylinder block extending around the space and extending the cylinder head across the cylinder block. Next, the method includes disposing the piston in the cylinder block and spacing the piston from the cylinder head to provide the combustion chamber therebetween. The method includes disposing the fuel injector in the combustion chamber for spraying fuel into the combustion chamber. The method further includes providing the igniter and disposing the igniter in the combustion chamber for receiving the high radio frequency voltage and emitting the radio frequency electric field to ionize the mixture of fuel and air and form the corona discharge. The step of providing the igniter includes forming the electrode by providing the electrode body portion extending longitudinally from the electrode terminal end to the electrode firing end. The step of providing the igniter also includes disposing the firing tip on the electrode body portion adjacent the electrode firing end and asymmetrically relative to the electrode center axis. The step of disposing the igniter in the combustion chamber includes positioning the igniter between the fuel injector and the cylinder block.

The corona igniter of the present invention, including the asymmetric firing tip, provides numerous advantages over corona igniters with other designs, such as those including a symmetric firing tip. The igniter can be disposed in a predetermined position relative to the fuel injector and cylinder block so that the corona discharge is formed in an optimal location for ignition and nowhere else. For example, a portion of the asymmetric firing tip having a greater surface area and producing a high electric field strength can be disposed closer to the fuel spray, while a portion of the firing tip having less surface area and producing a lower electric field strength is disposed closer to the cylinder block. Accordingly, the radio frequency electrical field is emitted only from the surface area adjacent the fuel spray so that the corona discharge is formed optimally at the outside edge of the fuel spray. The asymmetric firing tip also prevents power arcing between the firing tip and the cylinder block. Accordingly, the corona igniter of the present invention provides improved performance, compared to corona igniters including symmetric firing tips or other designs.

The igniter of the present invention is especially beneficial in non-homogeneous ignition systems, such as gasoline direct injection systems. The asymmetric firing tip is especially advantageous when the fuel injector must remain centrally located in the combustion chamber. The igniter can be moved away from the fuel spray to reduce corrosion and erosion, and closer to the cylinder block, without incurring the detrimental power arcing between the firing tip and cylinder block. Further, the asymmetric firing tip can be arranged to provide corona discharge projecting parallel to or away from the cylinder head, so that igniter can be moved closer to the cylinder head and away from the fuel spray. Another advantage of the present invention is improved energy efficiency, as the corona discharge is only produced where it can usefully provide ignition.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4A is a side view of a firing tip according to another embodiment of the invention, FIG. 4B is a top plan view of the firing tip of FIG. 4A, FIG. 5A is a side view of a firing tip according to yet another embodiment of the invention, FIG. 5B is a top plan view of the firing tip of FIG. 5A, FIG. 6A is a side view of a firing tip according to another embodiment of the invention, FIG. 6B is a top plan view of the firing tip of FIG. 6A, FIGS. 7A-7M are a top plan views of numerous example firing tips according to other embodiments of the invention.

DETAILED DESCRIPTION OF THE ENABLING EMBODIMENTS

Figure 1:
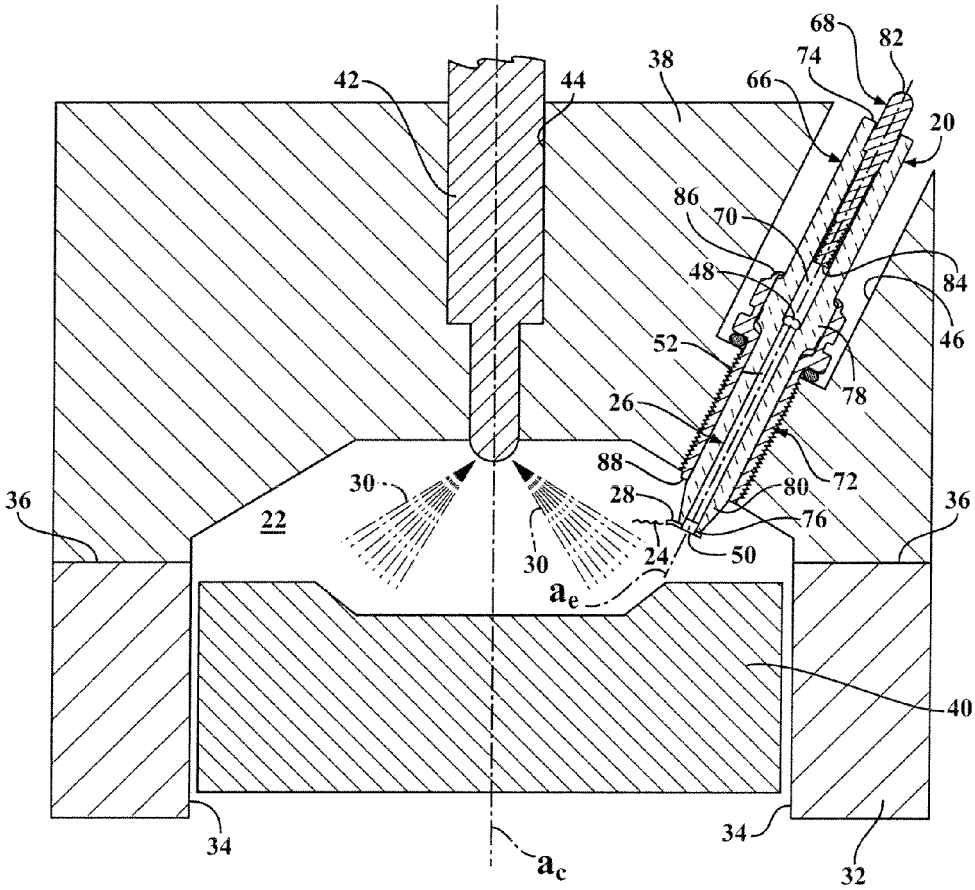
FIG. 1 is a cross-sectional view of a corona ignition system including an igniter according to one aspect of the invention.

One aspect of the invention provides a corona ignition system including an igniter 20 disposed in a combustion chamber 22 of an internal combustion engine, as shown in FIG. 1. The corona igniter 20 emits a radio frequency electric field to ionize a portion of a fuel-air mixture and provide a corona discharge 24 in the combustion chamber 22. The igniter 20 of the corona ignition system includes an electrode 26 with an asymmetric firing tip 28, also shown in FIG. 1. The asymmetric firing tip 28 allows the corona discharge 24 to be formed in an optimal location for ignition, preferably only at an outside edge 30 of a fuel spray, where the fuel mixes with the air. Thus, the igniter 20 of the corona ignition system provides multiple benefits, including prevention of power arcing and improved energy efficiency.

The corona ignition system is typically incorporated into an internal combustion engine of an automotive vehicle. As shown in FIG. 1, the system includes a cylinder block 32 having a side wall 34 extending circumferentially around a cylinder center axis $a_c$ and presenting a space having a cylindrical shape. The side wall 34 extends upwardly along the cylindrical space to a top end 36 surrounding a top opening. A cylinder head 38 is disposed on the top end 36 and extends across the top opening of the cylinder block 32.

A piston 40 is disposed in the cylindrical space and along the side wall 34 of the cylinder block 32 for sliding along the side wall 34 during operation of the internal combustion engine. The piston 40 is spaced from the cylinder head 38, so that the cylinder block 32 and the cylinder head 38 and the piston 40 together provide the combustion chamber 22 therebetween.

A fuel injector 42 is disposed in an injector slot 44 of the cylinder head 38 and extends transversely into the combustion chamber 22. The fuel injector 42 provides fuel to the combustion chamber 22, typically in the form of a finely atomized spray. In one embodiment, the fuel spray provided by the fuel injector 42 presents the outside edge 30 forming a conical shape, as shown in FIG. 1. The fuel injector 42 is typically located centrally in the cylinder and extends longitudinally along the cylinder center axis $a_c$. However, the fuel injector 42 can alternatively be air guided or wall guided, and the location of the fuel injector 42 may vary depending on the type of combustion system. In many internal combustion engine applications, the fuel injector 42 must be located centrally relative to the cylinder block 32, and it is impossible to move the fuel injector 42.

The cylinder head 38 also includes an igniter slot 46 between the fuel injector 42 and the cylinder block 32 for receiving the corona igniter 20. The igniter 20 can extend parallel to or at an angle relative to the cylinder center axis $a_c$ and into the combustion chamber 22. The igniter 20 receives the high radio frequency voltage and emits the radio frequency electric field to ionize a portion of the fuel-air mixture and form the corona discharge 24.

The precise location of the igniter 20 varies depending on the combustion system. The location of the igniter 20 may be determined by an alignment method disclosed in U.S. Patent Application Publication No. 2010/0083942, or another method. The igniter 20 is disposed in a predetermined position relative to the cylinder block 32 and the fuel injector 42 and the cylinder head 38 and the piston 40, which allows the corona discharge 24 to be formed in an optimal location for combustion. For example, the igniter 20 can be disposed a predetermined distance from the fuel injector 42 and the cylinder block 32 and the piston 40, and disposed at a predetermined angle relative to the fuel injector 42 and the cylinder head 38 and the cylinder block 32. The igniter 20 is also disposed in a predetermined location relative to the outside edge 30 of the fuel spray. For example, the igniter 20 can be disposed approximately at a 30 degree angle relative to the fuel injector 42, as shown in FIG. 1, so that the firing tip 28 is disposed in an optimal location adjacent the outside edge 30 of the fuel spray, and so that other portions of the igniter 20 are spaced further from the harsh environment created by the fuel spray.

Figure 2A:
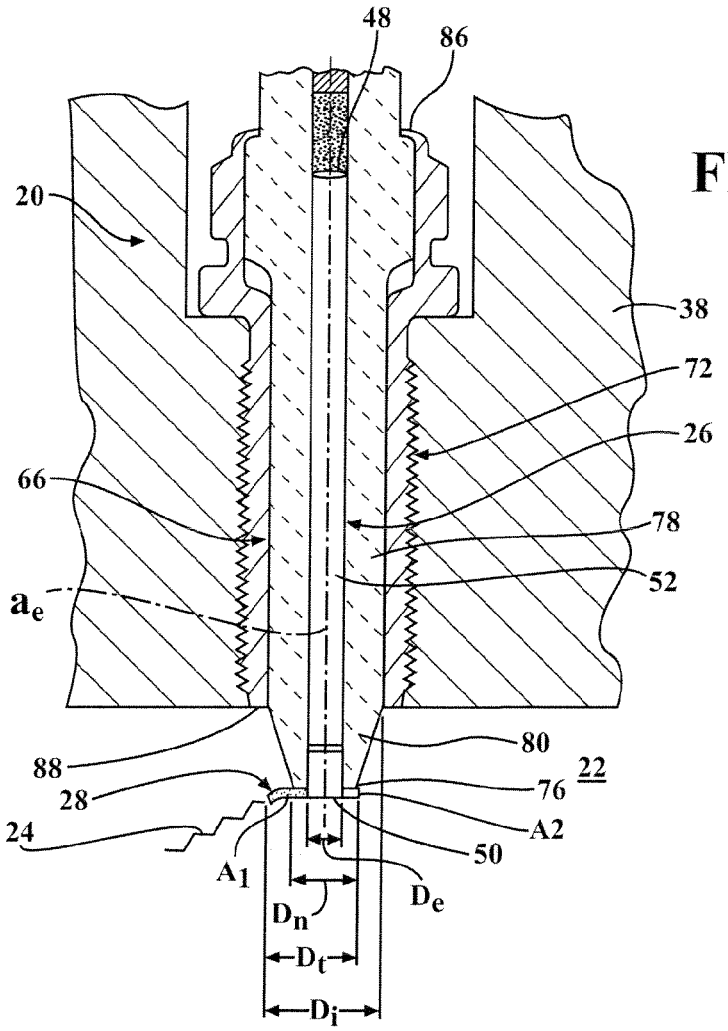
FIG. 2A is a cross-sectional view of the igniter of FIG. 1 with a first surface area shaded.
Figure 2B:
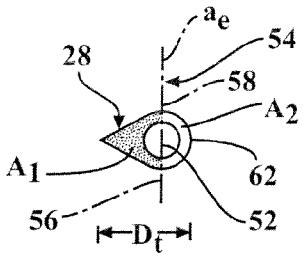
FIG. 2B is a top plan view of a firing tip of the igniter of FIG. 1 with the first surface area shaded.
Figure 3A:
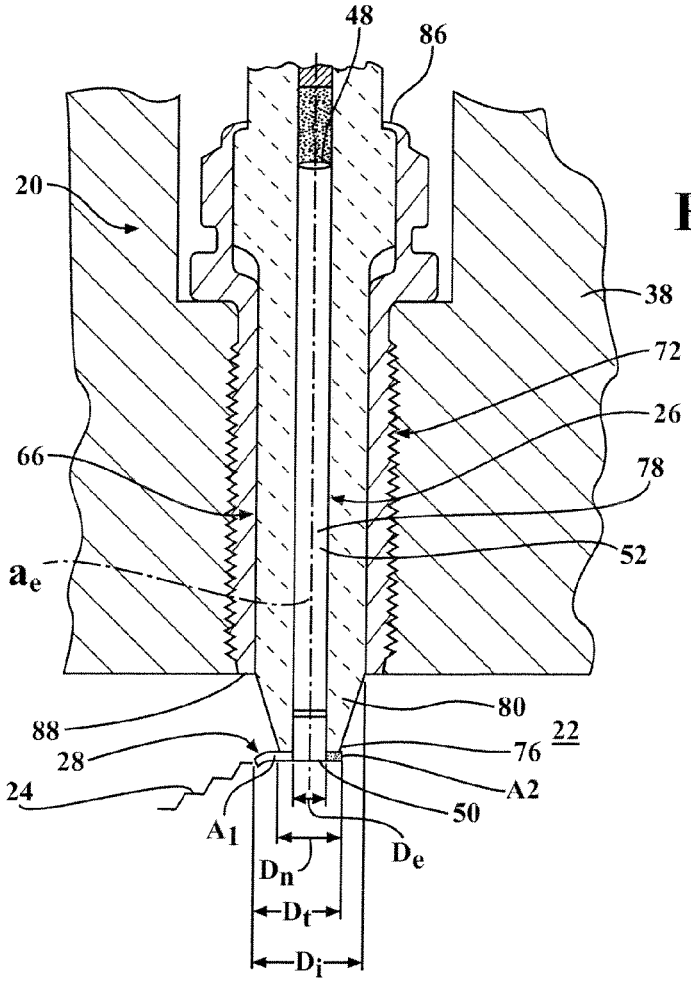
FIG. 3A is a cross-sectional view of the igniter of FIG. 1 with a second surface area shaded.
Figure 3B:
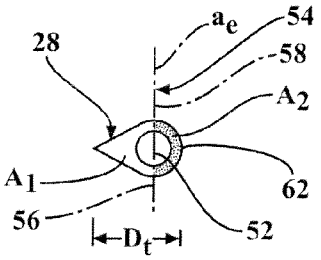
FIG. 3B is a top plan view of a firing tip of the igniter of FIG. 1 with the second surface area shaded.
Figure 7A:
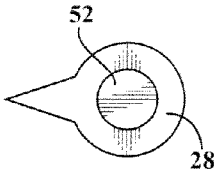
Figure 7B:
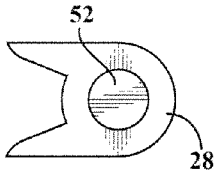
Figure 7C:
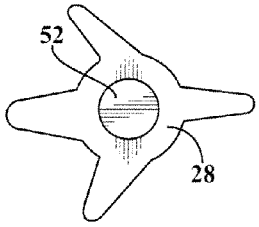
Figure 7D:
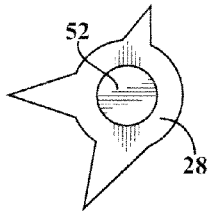
Figure 7E:
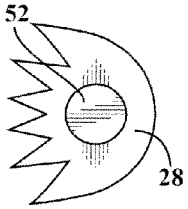
Figure 7F:
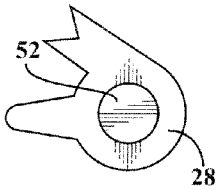
Figure 7G:
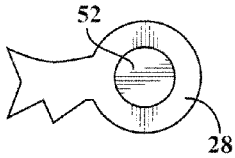
Figure 7H:
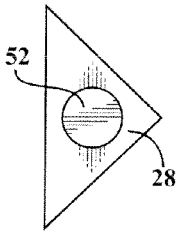
Figure 7I:
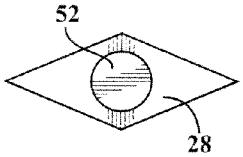
Figure 7J:
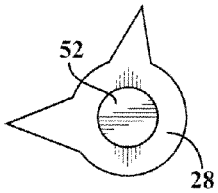
Figure 7K:
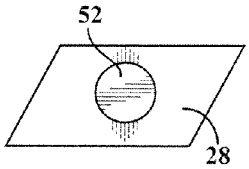
Figure 7L:
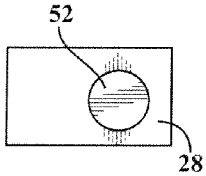
Figure 7M:
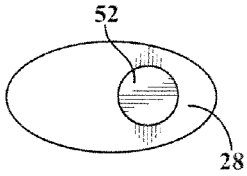

As shown in FIGS. 2A and 3A, the electrode 26 of the igniter 20 has an electrode center axis $a_e$ extending longitudinally from an electrode terminal end 48 receiving the high radio frequency voltage to an electrode firing end 50. The electrode 26 includes an electrode body portion 52 formed of a first electrically conductive material extending longitudinally from the electrode terminal end 48 along the electrode center axis $a_e$ to the electrode firing end 50. In one embodiment, the first electrically conductive material of the electrode body portion 52 includes nickel or a nickel alloy. The electrode body portion 52 has an electrode diameter $D_e$ being perpendicular to the electrode center axis $a_e$. As shown in FIGS. 2A and 3A, the electrode body portion 52 is symmetric relative to the electrode center axis $a_e$. The electrode body portion 52 is also symmetric relative to a hypothetical plane 54 extending through and longitudinally along the electrode center axis $a_e$, as shown in FIGS. 2B and 3B. The plane 54 has an injector side 56, which would face generally toward the fuel injector 42 of FIG. 1, and an opposite wall side 58 which would face generally toward the side wall 34 of the cylinder block 32 of FIG. 1.

The electrode 26 of the corona ignition system includes the firing tip 28 surrounding and adjacent the electrode firing end 50 for emitting the radio frequency electric field to ionize a portion of the fuel-air mixture in the combustion chamber 22 and provide the corona discharge 24. The firing tip 28 is formed of a second electrically conductive material, preferably including at least one element selected from Groups 4-12 of the Periodic Table of the Elements. The firing tip 28 typically has a tip diameter $D_t$ that is greater than the electrode diameter $D_e$ of the electrode body portion 52.

The firing tip 28 of the igniter 20 is disposed in a predetermined position relative to the cylinder block 32 and the fuel injector 42 and the cylinder head 38 and the piston 40, which allows the corona discharge 24 to be formed in the optimal location for combustion. For example, the firing tip 28 can be disposed a predetermined distance from the fuel injector 42 and the cylinder block 32 and the cylinder head 38 and the piston 40, and at a predetermined angle relative to the fuel injector 42 and the cylinder block 32 and the cylinder head 38 and the piston 40. The firing tip 28 is also disposed in a predetermined location relative to the outside edge 30 of the fuel spray. In one preferred embodiment, the firing tip 28 is disposed adjacent the fuel spray so that the corona discharge 24 is formed at the outside edge 30 of the fuel spray, as shown in FIG. 1. The method of U.S. Patent Application Publication No. 2010/0083942, or another method, can be used to determine the position of the firing tip 28 relative to the fuel injector 42 and the fuel spray. Since the firing tip 28 is asymmetric, the igniter 20 can be disposed closer to the side walls 34 of the cylinder block 32, relative to igniters of the prior art corona ignition systems, without incurring power arcing between the firing tip 28 and the cylinder block 32. Accordingly, the majority of the igniter 20 can be spaced further from the fuel spray and thus is less susceptible to erosion and corrosion caused by the harsh environment created by the fuel spray.

The firing tip 28 is asymmetric relative to the electrode body portion 52, so that the corona discharge 24 can be formed in an optimal location for ignition. As shown in FIGS. 2B and 3B, with regard to the plane 54 extending longitudinally through the electrode center axis $a_e$, the asymmetric firing tip 28 presents a first surface area $A_1$ on the injector side 56 of the plane 54 and a second surface area $A_2$ on the opposite wall side 58 of the center plane 54. The surface areas $A_1$, $A_2$ include the total area of all outward facing surfaces of the firing tip 28 exposed to the combustion chamber 22, including top, bottom, and side surfaces. In one embodiment, the first surface area $A_1$ of the firing tip 28 faces and extends outwardly generally toward the fuel injector 42 and the second surface area $A_2$ of the firing tip 28 faces generally toward the cylinder block 32 but does not extend outwardly. The first surface area $A_1$ of the firing tip 28 is greater than the second surface area $A_2$ of the firing tip 28 such that the firing tip 28 is asymmetric relative to the plane 54. FIGS. 2A and 2B show the firing tip 28 according to one embodiment, wherein a portion of the first surface area is shaded, and FIGS. 3A and 3B show the same firing tip 28 with a portion of the second surface area $A_2$ shaded. The surface areas $A_1$, $A_2$ of the firing tips 28 can be determined according to any surface area measurement technique known in the art.

In one preferred embodiment, the radio frequency electric field emitted from the first surface area $A_1$ facing the fuel injector 42 of the corona ignition system is stronger than the radio frequency electric field emitted from the second surface area $A_2$ facing the cylinder block 32 so that the corona discharge 24 can be formed in an optimal area of the combustion chamber 22. For example, in one preferred embodiment, the electrical field is emitted from the first surface area $A_1$ so that corona discharge 24 is formed optimally in the fuel spray or in a flammable region along the outside edge 30 of the fuel spray, with no electrical field emissions from the second surface area $A_2$. Accordingly, the corona ignition system provides a strong combustion of the fuel-air mixture, with no power arcing between the second surface area $A_2$ of the firing tip 28 and the cylinder block 32, which would hinder combustion.

The strength of the electrical field emitted from the surface areas $A_1$, $A_2$ of the firing tip 28 depends, in part, on distance from the center axis $a_c$. As shown in FIG. 2B, the first surface area $A_1$ extends a first distance $d_1$ away from the electrode center axis $a_c$ and the second surface area $A_2$ extends a second distance $d_2$ away from the electrode center axis $a_c$. Preferably, the first distance $d_1$ is greater than the second distance $d_2$. The greater distance helps provide a stronger radio frequency electric field being emitted from the first surface area $A_1$ facing the fuel injector 42 than the second surface area $A_2$ facing the cylinder block 32.

The design of the firing tip 28 can vary, and examples of the firing tip 28 are disclosed in FIGS. 1-8. In one embodiment, the first surface area $A_1$ is at least two times greater than the second surface area $A_2$, or at least three times greater, or at least four times greater, or more than four times greater. In several embodiments, such as the embodiments of FIGS. 4-6, the firing tip 28, typically the first surface area $A_1$, which is shaded, includes at least one projection 60 extending away from the electrode body portion 52 and presenting a portion of the first surface area $A_1$. In one embodiment, both the first and second surface areas $A_1$, $A_2$ of the firing tip 28 present at least one projection 60, or a plurality of projections 60, and the first surface area $A_1$ presents more projections 60 than the second surface area $A_2$. The projections 60 of the firing tip 28 preferably extend outwardly and downwardly away from the electrode 26 body portion. In the embodiment of FIG. 1, the igniter 20 is disposed such that the projection 60 of the firing tip 28 extends toward the fuel spray.

The projections 60 of the first surface area $A_1$ preferably include sharp edges to promote the radio frequency electrical field emissions and the optimally located corona discharge 24. Unlike the first surface area $A_1$, the second surface area $A_2$ preferably includes fewer or no sharp edges thus preventing radio frequency electrical field emissions and power arcing between the second surface area $A_2$ and the cylinder block 32, cylinder head 38, or piston 40, which could be detrimental to combustion. Any unavoidable edges of the second surface area $A_2$ are preferably as round as practically possible. As shown in FIGS. 2B, 3B, 4B, 5B, and 6B, the firing tip 28 may include an outward surface 62 being free of sharp edges and presenting a portion of the second surface area $A_2$.

Figure 8:
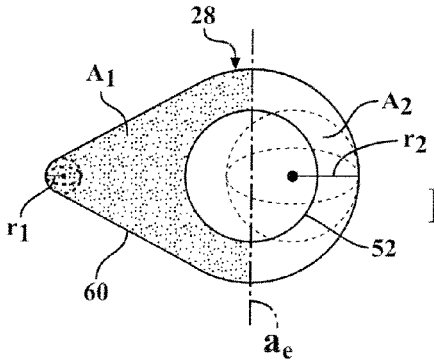
FIG. 8 is an enlarged top plan view of the firing tip of FIGS. 1-3.

The sharpness at particular points of the firing tip 28 can be defined by a spherical radius r. As shown in FIG. 8, the spherical radius r at a particular point along one of the surface areas $A_1$, $A_2$ of the firing tip 28 is determined using a hypothetical, three-dimensional sphere having a radius r at the particular point. The spherical radius r is the radius of the three-dimensional sphere. A spherical radius r between 0 and 0.010 inches may be described as a sharp edge.

FIG. 8 shows spherical radii $r_1$, $r_2$ presented by portions of the firing tip 28 of FIGS. 1-3. The projection 60 providing a portion of the first surface area $A_1$, which is shaded, presents a smaller spherical radius $r_1$ than a spherical radius $r_2$ presented by the outward surface 62 of the second surface area $A_2$. Therefore, due to the smaller spherical radius $r_1$ of the first surface area $A_1$, the radio frequency electric field emitted from the first surface area $A_1$ is greater than the radio frequency electric field emitted from the second surface area $A_2$. In one preferred embodiment, the outward surface 62 presenting the second surface area $A_2$ is round.

As best shown in FIGS. 2 and 3, the firing tip 28 is asymmetric relative to the electrode center axis $a_e$ and the plane 54 extending along the electrode center axis $a_e$. In one embodiment, the firing tip 28 is symmetric relative to itself, but disposed on the electrode body portion 52 asymmetrically so that the firing tip 28 is asymmetric relative to the electrode center axis $a_e$. The top planar views of FIG. 7 illustrate various possible firing tips 28, which are only examples and do not limit the possible designs of the present invention. In one embodiment, the firing tip 28 presents a triangular shape, such as an isosceles triangular shape. In another embodiment, the firing tip 28 presents a quadrilateral shape.

In yet another embodiment, as shown in FIGS. 4-6, the firing tip 28 is bifurcated or includes a plurality of divisions 64 presenting the first surface area $A_1$ and the second surface area $A_2$. FIGS. 4A, 5A, and 6A show side views of bifurcated firing tips 28, and 4B, 5B, and 6B show top plan views of the same firing tips 28. The firing tip 28 may include two divisions 64 or a plurality of divisions 64 together forming the asymmetric firing tip 28. In one embodiment, as shown in FIG. 4A, the firing tip 28 is disposed perpendicular relative to the electrode body portion 52 so that firing tip 28 and electrode 26 provide a 90 degree angle therebetween. In another embodiment, as shown in FIGS. 5A and 6A, the firing tip 28 is disposed at an angle relative to the electrode body portion 52 so that firing tip 28 and electrode body portion 52 provide angles other than 90 degrees therebetween.

Another aspect of the invention provides a method of forming the igniter 20. The method comprises the steps of providing the electrode body portion 52 extending longitudinally from the electrode terminal end 48 along the electrode center axis $a_e$ to the electrode firing end 50. The electrode body portion 52 provided is symmetric relative to the electrode center axis $a_e$. Next, the method includes disposing the firing tip 28 on the electrode body portion 52 adjacent the electrode firing end 50 such that the firing tip 28 is asymmetric relative to the electrode center axis $a_e$.

The igniter 20 of the corona ignition system includes other elements typically found in a corona igniter 20, such as an insulator 66, a terminal 68, a conductive seal layer 70, and a shell 72. The insulator 66 is disposed in the cylinder head 38 annularly around and longitudinally along the electrode body portion 52. As shown in FIG. 1, the insulator 66 extends from an insulator upper end 74 to an insulator lower end 76 spaced from the electrode firing end 50 such that the electrode firing end 50 and the firing tip 28 are disposed outwardly of the insulator lower end 76. The insulator 66 includes a matrix formed of an electrically insulating material, such as alumina. The electrically insulating material has a permittivity capable of holding an electrical charge. The insulating material also has an electrical conductivity less than the electrical conductivity of the electrode body portion 52 and the firing tip 28.

In one embodiment, the insulator 66 includes an insulator body region 78 disposed in the cylinder head 38 and extending from the insulator upper end 74 toward the insulator lower end 76. The insulator body region 78 presents an insulator body diameter $D_i$ generally perpendicular to the longitudinal electrode body portion 52. The insulator 66 also includes an insulator nose region 80 extending from the insulator body region 78 to the insulator lower end 76. The insulator nose region 80 presents an insulator nose diameter $D_n$ generally perpendicular to the longitudinal electrode body portion 52 and tapering to the insulator lower end 76. As shown in FIGS. 2A and 3A, the insulator nose diameter $D_n$ is less than the insulator body diameter $D_i$. The insulator body region 78 is disposed in the cylinder head 38 and is not exposed to the combustion chamber 22, while the insulator nose region 80 extends into the combustion chamber 22. In one embodiment, the insulator nose region 80 is disposed at a predetermined angle relative to the cylinder head 38, as shown in FIG. 5A. In another embodiment, the insulator nose region 80 extends perpendicular to the cylinder head 38, as shown in FIGS. 4A and 5A.

The insulator body region 78 is typically encased by the shell 72, which secures the igniter 20 to the cylinder head 38, and the insulator nose region 80 extends outwardly of the shell 72 into the combustion chamber 22. The insulator 66 and shell 72 typically include a center axis longitudinally aligned with the electrode center axis $a_e$ and one another, as shown in FIGS. 1-6.

The insulator 66 is disposed in a predetermined location relative to the fuel injector 42, the fuel spray, the cylinder head 38, and the cylinder block 32 so that the corona discharge 24 can be formed in an optimal location. Since the firing tip 28 is asymmetric, the igniter 20 can be disposed closer to the side walls 34 of the cylinder block 32, compared to igniters of the prior art corona ignition systems, without incurring power arcing between the firing tip 28 and the cylinder block 32. Accordingly, the insulator 66 of the igniter 20 can be spaced further from the fuel injector 42 and thus is less susceptible to erosion and corrosion caused by the harsh environment surrounding the fuel injector 42.

As shown in FIG. 1, the igniter 20 also includes a terminal 68 formed of an electrically conductive material received in the insulator 66. The terminal 68 includes a first terminal end 82, which is electrically connected to a terminal wire (not shown), which is electrically connected to a power source (not shown). The first terminal end 82 receives the high frequency voltage from the power source and transmits the high radio frequency voltage through a second terminal end 84 and to the electrode 26. The terminal 68 is electrically connected to the electrode terminal end 48 by a conductive seal layer 70 formed of an electrically conductive material. The conductive seal layer 70 is disposed between and electrically connects the second terminal end 84 and the electrode terminal end 48 for providing the energy from the terminal 68 to the electrode 26.

The shell 72 of the igniter 20 is formed of a metal material disposed in the cylinder head 38 and annularly around the insulator 66. The shell 72 extends longitudinally along the insulator 66 from an upper shell end 86 to a lower shell end 88 such that the insulator nose region 80 projects outwardly of the lower shell end 88, as shown in FIGS. 1, 2A, and 3A. The shell 72 may include plurality of threads engaging the injector slot 44 of the cylinder head 38 and securing the igniter 20 to the cylinder head 38.

Another aspect of the invention provides a method of forming the corona ignition system. The method includes providing the cylinder block 32 extending circumferentially around the cylindrical space, and extending the cylinder head 38 across the cylinder block 32. Next, the method includes disposing the piston 40 in the cylinder block 32 and spacing the piston 40 from the cylinder head 38 to provide the combustion chamber 22 therebetween. The method further includes disposing the fuel injector 42 in the combustion chamber 22 for spraying fuel into the combustion chamber 22.

The method next includes providing the igniter 20 and disposing the igniter 20 in the combustion chamber 22 for receiving the high radio frequency voltage and emitting the radio frequency electric field to ionize the fuel-air mixture and form the corona discharge 24. The step of providing the igniter 20 includes forming the electrode 26 by providing the electrode body portion 52 extending longitudinally from the electrode terminal end 48 along the electrode center axis $a_e$ to the electrode firing end 50 and being symmetric relative to the electrode center axis $a_e$. The step of providing the igniter 20 also includes disposing the firing tip 28 on the electrode body portion 52 adjacent the electrode firing end 50 and such that the firing tip 28 is asymmetric relative to the electrode center axis $a_e$. The step of disposing the igniter 20 in the combustion chamber 22 includes positioning the igniter 20 between the fuel injector 42 and the cylinder block 32. In one embodiment, the method includes disposing the firing tip 28 in a predetermined location relative to the fuel injector 42 and the cylinder block 32. In another embodiment, the method includes disposing the firing tip 28 at a predetermined angle relative to the fuel injector 42 and the cylinder block 32.

During operation of the corona ignition system, the electrode 26 of the igniter 20 is charged to a high radio frequency voltage potential, creating a radio frequency electric field in the combustion chamber 22. The electric field is controlled so that the fuel-air mixture in the combustion chamber 22 maintains dielectric properties. The electrode 26 emits a non-thermal plasma including multiple streams of ions forming a corona to ionize a portion of the fuel-air mixture in the combustion chamber 22.

The corona ignition system of the present invention with the asymmetric firing tip 28 provides numerous benefits over other corona ignition systems having different designs, such as those without the asymmetric firing tip 28, especially in non-homogeneous combustion systems, like gasoline direct ignition systems. The asymmetric firing tip 28 can provide an optimally located ignition source providing a robust combustion of the fuel-air mixture. The asymmetric firing tip 28 can be arranged to provide corona discharge 24 projecting parallel to or away from the cylinder head 38, so that the igniter 20 can be moved closer to the cylinder head 38 and away from the fuel spray to reduce erosion and corrosion caused by the fuel spray. The igniter 20 can also be moved away from the fuel spray and closer to the cylinder block 32 without creating the detrimental power arcing. The present invention also uses energy more efficiently than systems including igniters with symmetric firing tips or other designs. Preferably, the electrical field emissions and corona discharge 24 are only formed on the side of the firing tip 28 facing the fuel spray, where it can usefully provide ignition, rather than on both sides of the firing tip 28, where a significant amount of the electrical field emissions would not contribute to ignition and therefore would be wasted energy.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. In addition, the reference numerals in the claims are merely for convenience and are not to be read in any way as limiting.

ELEMENT LIST

| Element Symbol | Element Name |
|---|---|
| r | spherical radius |
| 20 | igniter |
| 22 | combustion chamber |
| 24 | corona discharge |
| 26 | electrode |
| 28 | firing tip |
| 30 | outside edge |
| 32 | cylinder block |
| 34 | side wall |
| 36 | top end |
| 38 | cylinder head |
| 40 | piston |
| 42 | injector |
| 44 | injector slot |
| 46 | igniter slot |
| 48 | electrode terminal end |
| 50 | electrode firing end |
| 52 | electrode body portion |
| 54 | plane |
| 56 | injector side |
| 58 | wall side |
| 60 | projection |
| 62 | outward surface |
| 64 | divisions |
| 66 | insulator |
| 68 | terminal |
| 70 | conductive seal layer |
| 72 | shell |
| 74 | insulator upper end |
| 76 | insulator lower end |
| 78 | insulator body region |
| 80 | insulator nose region |
| 82 | first terminal end |
| 84 | second terminal end |
| 86 | upper shell end |
| 88 | lower shell end |
| $A_1$ | first surface area |
| $A_2$ | second surface area |
| $a_c$ | cylinder center axis |
| $a_e$ | electrode center axis |
| $D_e$ | electrode diameter |
| $D_i$ | insulator body diameter |
| $D_n$ | insulator nose diameter |
| $D_t$ | tip diameter |

What is claimed is:

1. An igniter for receiving a high radio frequency voltage and emitting a radio frequency electric field to ionize a portion of a fuel-air mixture and provide a corona discharge, comprising:

an electrode including an electrode body portion extending longitudinally from an electrode terminal end for receiving the high radio frequency voltage along an electrode center axis to an electrode firing end, said electrode including a firing tip adjacent said electrode firing end disposed on said electrode body portion for emitting the radio frequency electric field, said firing tip being asymmetric relative to a plane extending through and longitudinally along said electrode center axis, said firing tip presenting a first surface area on one side of said plane and a second surface area on the opposite side of said plane, wherein said first surface area is greater than said second surface area, and said first surface area of said firing tip presents a first spherical radius being between 0 and 0.010 inches and said second surface area of said firing tip presents a second spherical radius being greater than said first spherical radius.

2. The igniter of claim 1 wherein said first surface area is at least two times greater than said second surface area.

3. An igniter for receiving a high radio frequency voltage and emitting a radio frequency electric field to ionize a portion of a fuel-air mixture and provide a corona discharge, comprising:

an electrode including an electrode body portion extending longitudinally from an electrode terminal end for receiving the high radio frequency voltage along an electrode center axis to an electrode firing end, said electrode including a firing tip adjacent said electrode firing end disposed on said electrode body portion for emitting the radio frequency electric field, said firing tip being asymmetric relative to a plane extending through and longitudinally along said electrode center axis, said firing tip presenting a first surface area on one side of said plane and a second surface area on the opposite side of said plane, wherein said first surface area is greater than said second surface area, and said surface areas of said firing tip present a plurality of projections and said first surface area presents more projections than said second surface area.

4. The igniter of claim 1 wherein said first surface area of said firing tip extends a first distance away from said electrode center axis and said second surface area of said firing tip extends a second distance away from said electrode center axis and wherein said first distance is greater than said second distance.

5. The igniter of claim 1 wherein said electrode body portion is symmetric relative to said plane extending through and longitudinally along said electrode center axis.

6. The igniter of claim 1 wherein said electrode body portion is symmetric relative to said electrode center axis.

7. The igniter of claim 1 wherein said firing tip is symmetric relative to itself and asymmetric relative to said electrode center axis.

8. The igniter of claim 1 wherein said firing tip includes a plurality of divisions.

9. The igniter of claim 1 wherein said electrode body portion has an electrode diameter perpendicular to said electrode center axis and said firing tip has a tip diameter greater than said electrode diameter.

10. A corona ignition system for providing a radio frequency electric field to ionize a portion of a fuel-air mixture and provide a corona discharge igniting the fuel-air mixture in a combustion chamber of an internal combustion engine, comprising:

a cylinder block extending circumferentially around a space, a cylinder head extending across said cylinder block, a piston disposed in said cylinder block and spaced from said cylinder head and providing a combustion chamber therebetween, a fuel injector extending into said combustion chamber for spraying fuel into said combustion chamber, an igniter extending into said combustion chamber for receiving the high radio frequency voltage and emitting the radio frequency electric field to ionize said fuel-air mixture and form a corona discharge, said igniter being disposed between said fuel injector and said cylinder block, an electrode including an electrode body portion extending longitudinally from an electrode terminal end for receiving the high radio frequency voltage along an electrode center axis to an electrode firing end, said electrode including a firing tip adjacent said electrode firing end disposed on said electrode body for emitting the radio frequency electric field, said firing tip being asymmetric relative to a plane extending through and longitudinally along said electrode center axis, wherein said plane has an injector side facing generally toward said fuel injector and an opposite wall side facing generally toward said cylinder block, said firing tip presents a first surface area on said injector side of said plane and a second surface area on said opposite wall side of said plane, said first surface area faces generally toward said fuel injector and said second surface area faces generally toward said cylinder block, said first surface area is greater than said second surface area, and said first surface area of said firing tip presents a projection having a first spherical radius and said second surface area of said firing tip forms an outward surface presenting a second spherical radius, and wherein said first spherical radius is smaller than said second spherical radius so that the radio frequency electric field emitted from said first surface area is greater than the radio frequency electric field emitted from said second surface area.

11. The corona ignition system of claim 10 wherein said first surface area is at least two times greater than said second surface area.

12. The corona ignition system of claim 10 wherein said electrode body portion is symmetric relative to said electrode center axis.

13. The corona ignition system of claim 10 wherein said firing tip is disposed in a predetermined location relative to said fuel injector and said fuel spray and said corona discharge is formed between said igniter and said fuel injector and not between said firing tip and said cylinder block.

14. The corona ignition system of claim 10 wherein said fuel spray has an outside edge and wherein said firing tip is disposed a predetermined distance from said outside edge.

15. The corona ignition system of claim 10 wherein said igniter is disposed a predetermined distance from said fuel injector and said piston and said cylinder block.

16. The corona ignition system of claim 10 wherein said fuel injector is disposed parallel to said cylinder block and said igniter is disposed at a predetermined angle relative to said fuel injector and said cylinder block.

17. A corona ignition system for providing a radio frequency electric field to ionize a portion of a fuel-air mixture and provide a corona discharge in a combustion chamber of an internal combustion engine, comprising a cylinder block having a side wall extending circumferentially around a cylinder center axis and presenting a space having a cylindrical shape, said side wall being disposed a predetermined distance from said cylinder center axis, said side wall having a top end surrounding a top opening, a cylinder head disposed on said top end and extending across said top opening of said cylinder block, a piston disposed in said cylindrical space and along said side wall of said cylinder block for sliding along said side wall during operation of the internal combustion engine, said piston being spaced from said cylinder head, said cylinder block and said cylinder head and said piston providing a combustion chamber therebetween, a fuel injector disposed in said cylinder head and extending transversely into said combustion chamber for spraying fuel into said combustion chamber, wherein said fuel is in the form of a finely atomized spray and wherein said fuel spray has an outside edge presenting a conical shape, said cylinder head presenting a injector slot for receiving said fuel injector, said fuel injector extending longitudinally along said cylinder center axis, an igniter disposed in said cylinder head and extending transversely into said combustion chamber for receiving the high radio frequency voltage and emitting the radio frequency electric field to ionize a portion of the fuel-air mixture and form said corona discharge, said cylinder head presenting an igniter slot for receiving said igniter, said igniter being disposed between said fuel injector and said cylinder block, said igniter being disposed a predetermined distance from said fuel injector and said cylinder block and said piston, said igniter being disposed at a predetermined angle relative to said fuel injector and said cylinder head and said cylinder block and said piston, said igniter being disposed in a predetermined location relative to said outside edge of said fuel spray, said igniter including an electrode having an electrode center axis extending longitudinally from an electrode terminal end for receiving the high radio frequency voltage to an electrode firing end, said electrode including an electrode body portion formed of a first electrically conductive material extending longitudinally from said electrode terminal end along said electrode center axis to said electrode firing end, said first electrically conductive material of said electrode body portion including nickel, said electrode body portion having an electrode diameter being perpendicular to said electrode center axis, said electrode body portion being symmetric relative to said electrode center axis and relative to a plane extending through and longitudinally along said electrode center axis, wherein said plane has an injector side facing generally toward said fuel injector and an opposite wall side facing generally toward said side wall of said cylinder block, said electrode including a firing tip surrounding and adjacent said electrode firing end for emitting the radio frequency electric field to ionize a portion of the fuel-air mixture in said combustion chamber and provide said corona discharge at said outside edge of said fuel spray in said combustion chamber, said firing tip being formed of a second electrically conductive material, said second electrically conductive material including at least one element selected from Groups 4-12 of the Periodic Table of the Elements, said firing tip having a tip diameter being greater than said electrode diameter of said electrode body portion, said firing tip being disposed a predetermined distance from said fuel injector and said cylinder block and said cylinder head and said piston, said firing tip being disposed at a predetermined angle relative to said fuel injector and said cylinder block and said cylinder head and said piston, said firing tip being disposed in a predetermined location relative to said outside edge of said fuel spray, said firing tip being asymmetric relative to said electrode body portion, said firing tip presenting a first surface area on said injector side of said plane and a second surface area on said opposite wall side of said plane, wherein said first surface area faces and extends outwardly generally toward said fuel injector and said second surface area faces generally toward said cylinder block and does not extend outwardly, said first surface area of said firing tip being greater than said second surface area of said firing tip such that said firing tip is asymmetric relative to said plane, said first surface area of said firing tip being disposed a predetermined distance from said fuel injector and said outside edge of said fuel spray for forming said corona discharge at said outside edge of said fuel spray, said first surface area being at least two times greater than said second surface area, said first surface area of said firing tip presenting a first spherical radius being between 0 and 0.010 inches and said second surface area of said firing tip presenting a second spherical radius being greater than said first spherical radius, an insulator disposed in said cylinder head annularly around and longitudinally along said electrode body portion and extending from an insulator upper end to an insulator lower end spaced from said electrode firing end and said firing tip of said electrode such that said electrode firing end and said firing tip are disposed outwardly of said insulator lower end, said insulator including a matrix formed of an electrically insulating material, said electrically insulating material including alumina, said electrically insulating material having a permittivity capable of holding an electrical charge, said electrically insulating material having an electrical conductivity less than the electrical conductivity of said electrically conductive material of said electrode body portion and said firing tip, said insulator including an insulator body region disposed in said cylinder head and extending from said insulator upper end toward said insulator lower end, said insulator body region presenting an insulator body diameter generally perpendicular to said longitudinal electrode body portion, said insulator body region being not exposed to said combustion chamber, said insulator including an insulator nose region disposed in said combustion chamber and extending from said insulator body region to said insulator lower end, said insulator nose region presenting an insulator nose diameter generally perpendicular to said longitudinal electrode body portion and tapering to said insulator lower end, said insulator nose diameter being less than said insulator body diameter, a terminal received in said insulator for being electrically connected to a terminal wire and electrically connected to a power source and being in electrical communication with said electrode for receiving the high radio frequency voltage from the power source and transmitting the high radio frequency voltage to said electrode, said terminal extending from a first terminal end to a second terminal end electrically connected to said electrode terminal end, said terminal being formed of an electrically conductive material, a conductive seal layer disposed between and electrically connecting said second terminal end of said terminal and said electrode terminal end for providing the energy from said terminal to said electrode, said conductive seal layer being formed of an electrically conductive material, a shell disposed in said cylinder head and annularly around said insulator, said shell extending longitudinally along said insulator from an upper shell end to a lower shell end such that said insulator nose region projects outwardly of said lower shell end, said shell including a plurality of threads engaging said injector slot of said cylinder head and securing said igniter to said cylinder head, and said shell being formed of a metal material.

18. A method of forming an igniter for receiving a high radio frequency voltage and emitting a radio frequency electric field to ionize a portion of a fuel-air mixture and provide a corona discharge, comprising the steps of:

providing an electrode body portion extending longitudinally from an electrode terminal end along an electrode center axis to an electrode firing end, and disposing a firing tip on the electrode body portion adjacent the electrode firing end and asymmetrically relative to a plane extending through and longitudinally along the center axis electrode, the firing tip presenting a first surface area on one side of the plane and a second surface area on the opposite side of the plane, wherein the first surface area is greater than the second surface area, the first surface area presents a first spherical radius being between 0 and 0.010 inches, and the second surface area presents a second spherical radius being greater than the first spherical radius.

19. A method of forming a corona ignition system for providing a radio frequency electric field to ionize a portion of a fuel-air mixture and provide a corona discharge igniting the fuel-air mixture in a combustion chamber of an internal combustion engine, comprising the steps of:

providing a cylinder block extending around a space, extending a cylinder head across the cylinder block, disposing a piston in the cylinder block and spaced from the cylinder head to provide a combustion chamber therebetween, disposing a fuel injector in the combustion chamber for spraying fuel into the combustion chamber, providing an igniter and positioning the igniter in the combustion chamber between the fuel injector and the cylinder block for receiving the high radio frequency voltage and emitting the radio frequency electric field to ionize a mixture of the fuel and air and form a corona discharge, the providing the igniter step including forming an electrode by providing an electrode body portion extending longitudinally from an electrode terminal end for receiving the high radio frequency voltage along an electrode center axis to an electrode firing end, the forming the electrode step including disposing a firing tip for emitting the radio frequency electric field on the electrode body portion adjacent the electrode firing end and asymmetrically relative to a plane extending through and longitudinally along the electrode center axis, wherein the plane has an injector side facing generally toward the fuel injector and an opposite wall side facing generally toward the cylinder block, the firing tip presents a first surface area on the injector side of the plane and a second surface area on the opposite wall side of the plane, the first surface area faces generally toward the fuel injector and the second surface area faces generally toward the cylinder block, the first surface area is greater than the second surface area, and the first surface area of the firing tip presents a projection having a first spherical radius and the second surface area of the firing tip forms an outward surface presenting a second spherical radius, and wherein the first spherical radius is smaller than the second spherical radius so that the radio frequency electric field emitted from the first surface area is greater than the radio frequency electric field emitted from the second surface area.

20. The method of claim 19 including disposing the firing tip in a predetermined location relative to the fuel injector and the cylinder block.

21. The method of claim 19 including disposing the firing tip at a predetermined angle relative to the fuel injector and the cylinder block.

* * * * *